US006427569B2

(12) United States Patent
MacDonald

(10) Patent No.: US 6,427,569 B2
(45) Date of Patent: Aug. 6, 2002

(54) METHOD AND TOOL FOR REPAIRING SEAMS IN SHEET MATERIALS

(75) Inventor: Lea MacDonald, Tichborne (CA)

(73) Assignee: Orcon Corporation, Union City, CA (US)

( * ) Notice: Subject to any disclaimer, the term of this patent is extended or adjusted under 35 U.S.C. 154(b) by 0 days.

(21) Appl. No.: 09/809,410

(22) Filed: Mar. 15, 2001

Related U.S. Application Data

(62) Division of application No. 09/503,974, filed on Feb. 14, 2000, now Pat. No. 6,308,422.

(51) Int. Cl.[7] ..... B26B 3/00

(52) U.S. Cl. ..... 83/13; 30/304; 30/125; 30/317; 30/321

(58) Field of Search ..... 83/13; 30/304, 30/125, 317, 321, 305, 312, 320

(56) References Cited

U.S. PATENT DOCUMENTS 1,589,156 A * 6/1926 Hartman ..... 30/293
2,091,337 A * 8/1937 Sahl ..... 30/2
2,176,733 A * 10/1939 Fanning ..... 30/304
2,770,878 A * 11/1956 Rosenberger ..... 30/280
3,270,368 A * 9/1966 Cook, Sr. et al. ..... 30/304
3,456,346 A * 7/1969 Snyder ..... 30/151
3,765,282 A * 10/1973 Crain, Jr. ..... 30/130
4,472,879 A * 9/1984 Sizemore, Jr. ..... 30/287
4,578,865 A * 4/1986 Keller ..... 30/162
4,630,369 A * 12/1986 Bourland ..... 30/2
5,010,650 A * 4/1991 Despins et al. ..... 30/299
5,014,429 A * 5/1991 McNamara ..... 30/162
5,435,062 A * 7/1995 Huang ..... 30/125
5,778,536 A * 7/1998 West ..... 30/123
6,029,355 A * 2/2000 Carlin ..... 30/287
6,308,422 B1 * 10/2001 MacDonald ..... 30/125

* cited by examiner

*Primary Examiner*—Boyer Ashley
(74) *Attorney, Agent, or Firm*—O'Melveny & Myers LLP

(57) ABSTRACT

A method and tool for repairing worn seams in sheet materials, such as linoleum or vinyl floor coverings, is disclosed. The tool is a specially constructed, double bladed utility knife. The tool has dual cutting blades that are rigidly secured to the tool for precision cutting. The blades are set at a slightly divergent angle relative to one another, and the distance between the blades is adjustable. The tool may be used to repair a damaged seam in a floor covering as follows. First, the blades are set to span the widest portion of the damaged portion of the seam. Cutting pressure is applied and the tool is drawn along the seam to remove the damaged portion. The blades are then adjusted to a slightly wider-apart position, and the tool is used in a similar manner to cut a repair piece from a matching piece of material. The repair piece is then adhered to the floor and will fit snugly between the adjoining pieces of material to accomplish a perfect repair of the seam.

5 Claims, 5 Drawing Sheets

METHOD AND TOOL FOR REPAIRING SEAMS IN SHEET MATERIALS

This application is a division of application Ser. No. 09/503,974, filed Feb. 14, 2000, now U.S. Pat. No. 6,308, 422.

BACKGROUND OF THE INVENTION

1. Field of the Invention

My invention relates to tools and methods for repairing seams in certain types of sheet materials. More particularly, my invention relates to repairing seams in pliable sheet materials that are used as functional and decorative surface coverings, such as linoleum or vinyl floor coverings. Such materials are adhered to the surface (usually a floor) that is to be covered. Butt seams are used to join separate pieces of such materials when the desired area cannot be covered by a single piece. Hereinafter, I use the term "sheet materials" to refer only to pliable sheets of materials that are relatively smooth on both major surfaces, such as sheets of vinyl and other polymeric materials, and laminates thereof. I use "floor coverings" to refer only to such sheet materials that are used to cover floors, excluding rigid flooring such as wooden laminates or ceramic tiles, and excluding textiles such as carpeting.

2. Description of the Related Art

When abutting pieces of floor covering are seamed together and glued in place, the seam will often degrade over time because of exposure to traffic, moisture, cleaning chemicals, and dirt. Contamination will eventually penetrate the seam and degrade the adhesive holding the floor covering to the floor at the seam. When the adhesive becomes degraded, the floor covering will lift from the floor at the seam, lending the seam an unsightly puckered appearance and making the seam more vulnerable to further damage. In order to repair the damaged portion of the seam, it is usually necessary to carefully cut out and replace it with a fresh patch of matching material. The patch must match the removed portion's pattern and shape perfectly, or the repair will be visible.

Currently, no tools like my invention are available for repairing seams in floor covering materials. A craftsperson must make do with conventional cutting tools, such as construction knives and straight edges to accomplish the precision repair job required. It is very difficult to exactly match the shape and decorative pattern of the patch to that of the removed portion. It is especially difficult to exactly match the edge surfaces of the patch to the edge of the removed portion so that the resulting butt seam will be as good as the original. To make a perfect seam, a craftsperson must cut the patch to exactly match the removed portion not only in the two-dimensional geometry of the floor, but also along the third dimension defined by the sheet thickness along its edge. A mismatch in any dimension will create a weakness or visible imperfection along the edges of the patch. Consequently, only the most skilled craftspeople are able to repair the seam so that the patch is both invisible and durable, and only by the exercise of great care.

Various double-bladed knifes, scalpels, and cutting tools exist for cutting various materials, and some of these double-bladed tools may be capable of cutting floor coverings. However, no existing tool is adapted for repairing damaged seams in floor coverings like my device, and no method like my method has been developed before.

Thus, a need exists for way to repair damaged seams in floor coverings that is easier to use than present methods, and consistently achieves a perfect repair that is invisible and durable. It is further desirable that any tool used for the repair be rugged, reliable, easy to operate, and relatively inexpensive so that it may be used by professional craftspeople and amateurs alike.

SUMMARY OF THE PRESENT INVENTION

Objects and Advantages

The chief object and advantage of my invention are to make it much easier and faster than present methods to perfectly repair a damaged seam in floor coverings. Craftspeople and amateur repair people of many different skill levels and abilities are able to competently repair a seam using my tool and method. My invention consists of a hand held precision cutting tool and a method for using the tool to repair a seam. I have designed the tool to be inexpensive to construct, rugged, reliable, and easy to operate. The method for using it consists of a limited number of steps that are easy to teach, easy to learn, and easy to do. My repair procedure can also be performed much more quickly than current methods. Thus, my invention will be of value to anyone who needs to repair seams in sheet materials, and especially floor coverings.

Theory of Operation

My repair tool is essentially a specially designed double-bladed precision knife with adjustable blades. The dual blades are nearly parallel but are inclined slightly to make a cut that is beveled slightly away from the centerline of the tool, to undercut the material being repaired. Each blade is a rigid precision blade and is securely fixed to the body of the tool near each blade's working edge. Thus the cutting blades are more stable than blades in conventional utility knives and are capable of making precision cuts. The distance between the blades is adjustable by means of a fine pitch adjustment screw attached to a thumbwheel. The adjustment screw is back loaded to remove adjustment slop and prevent unintentional movement of the screw.

To use my repair tool, an operator sets the distance between the blades to just slightly wider than the widest portion of the damaged seam to be removed. The operator then draws my tool along the seam with the blades straddling the seam, while applying downward cutting pressure. The operator then removes the material between the parallel cuts, and cleans out the resulting groove. Then, from a piece of scrap material that matches the pattern of the removed material, the operator cuts a strip of the same length and pattern as the removed material. This will serve as the repair strip. However, before cutting the repair strip, the operator adjusts the blades of the knife to be slightly wider apart than when cutting out the damaged portion of the seam. This ensures that the repair strip will fit snugly into the groove previously cut in the material to be repaired. The operator then applies a small amount of flooring adhesive along the bottom of the groove and, using a roller, presses the repair strip in place along the groove. The matching bevels of the repair strip and the groove help to lock the repair strip in place. Furthermore, the edges of the repair piece match the groove perfectly and are uniformly snug along the length of the patch. Thus, the repair strip is held firmly in place with its edges as good or better than the original seam. To complete the repair, the operator applies a conventional seam sealing adhesive to seal the patch and protect it from contamination.

DESCRIPTION OF PREFERRED EMBODIMENTS

Figure 1A:
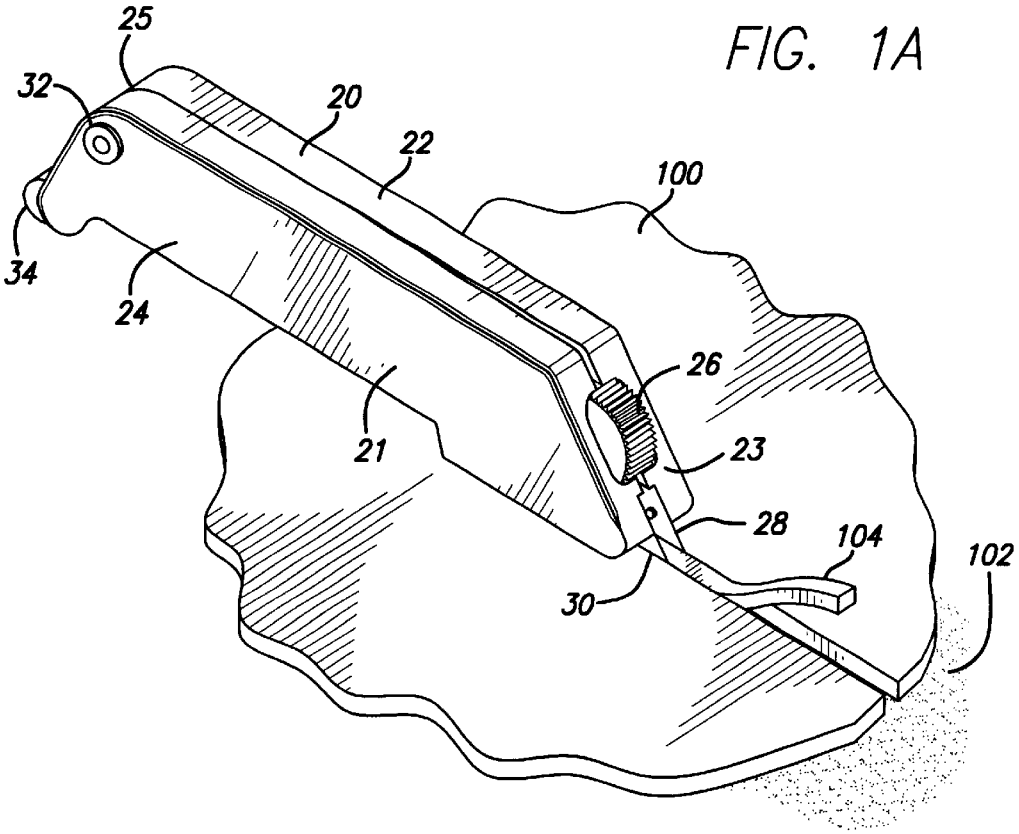
FIG. 1A is an isometric view of my repair tool shown cutting a piece of floor covering.

The preferred structure of my repair tool 20 is depicted in FIGS. 1A through 11. FIGS. 2 through 11 are drawn full scale. The basic form and strength of tool 20 is preferably provided by first body section 22 and second body section 24, which together form a handle 21. My repair tool 20 is preferably a hand tool operable by one or two hands of one person. Body sections 22 and 24 are preferably cast from a durable metal such as aluminum or similar lightweight and economical die casting alloys. For lighter weight and lower cost, at the expense of some durability, sections 22 and 24 may be molded from hard and durable plastics such as Nylon®. Sections 22 and 24 may also be milled from any hard and durable material, but molding or casting is preferable for volume production.

Figure 9:
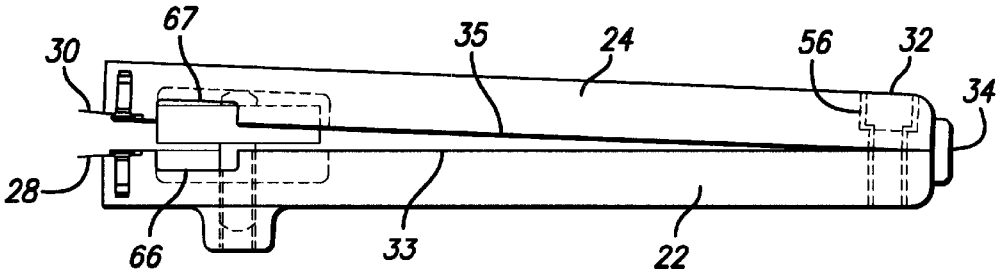
FIG. 9 is a top view of my repair tool, showing the cutting blades spread apart in a wide position, with dashed lines indicating the position of selected hidden interior parts.
Figure 10:
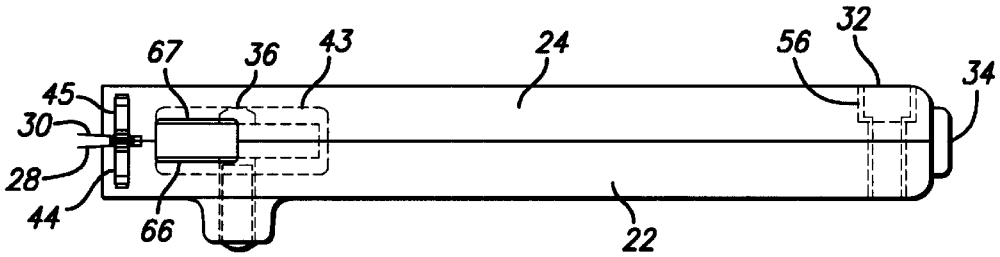
FIG. 10 is a top view of my repair tool, showing the cutting blades in their closest or narrowest position, with dashed lines indicating the position of selected hidden interior parts.

Sections 22 and 24 are preferable joined at their second end 25 by fastener 32 to form a handle 21. Fastener 32 is positioned so that mating surfaces 33 and 35 of sections 22 and 24 will touch along the length of tool 20 when adjustment screw 38 is in the close position, as shown in FIG. 10. Fastener 32 and the portion of sections 22 and 24 rearward of fastener 32 will then exert a gradually increasing back load on adjustment screw 32 as it is adjusted from a close position to a wider position, as shown in FIG. 9. To provide an appropriate amount of adjustability and back load, the centers of adjustment screw 38 and fastener 32 are preferably spaced four to five inches apart. Fastener 32 is preferably a one-quarter inch steel machine screw, or similar fastener. Sections 22 and 24 may be disassembled by removal of fastener 32 to permit replacement of blades 28 and 30.

Figure 1B:
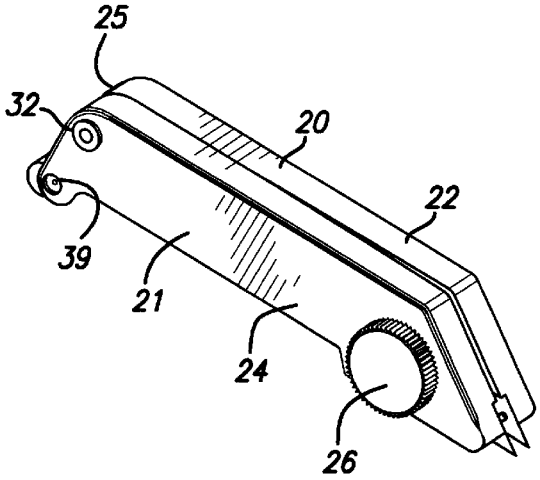
FIG. 1B in an isometric view at about ¾ scale of an alternative embodiment of my repair tool.
Figure 2:
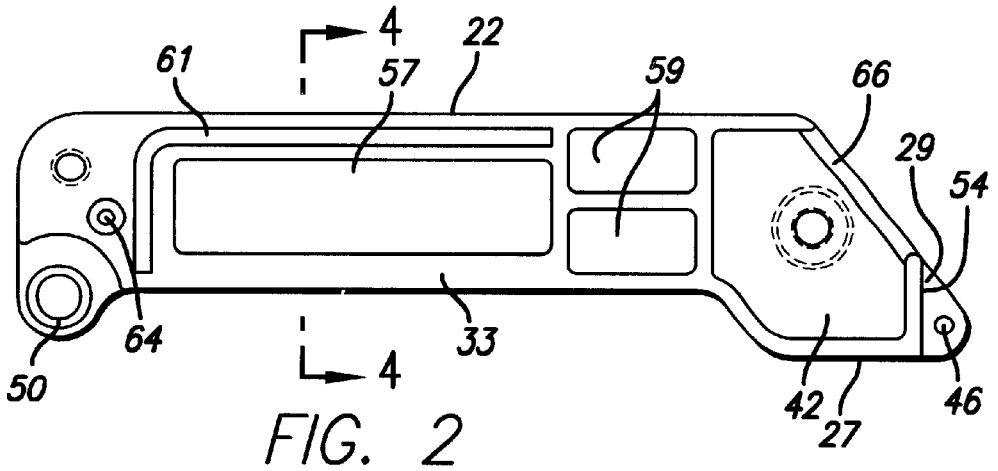
FIG. 2 is a plan view of the interior of a first body section of my repair tool.
Figure 3:
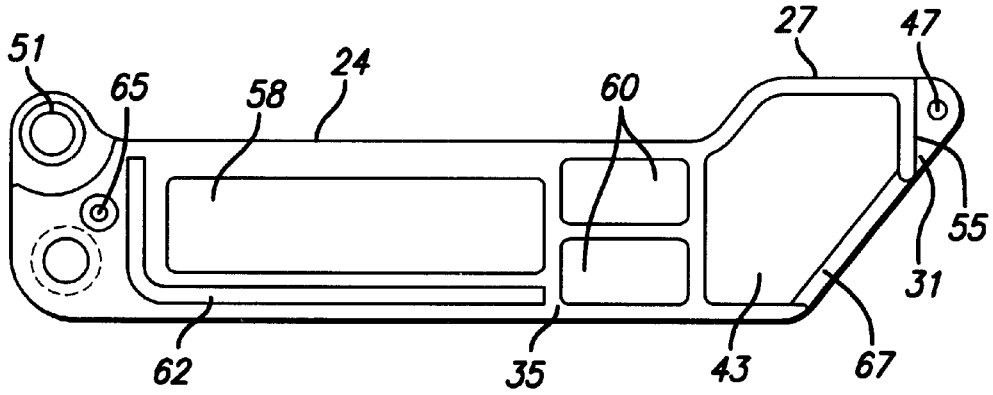
FIG. 3 is a plan view of the interior of a second body section of my repair tool.

In an alternative embodiment, an additional fastener 39 is provided at the second end 25 of tool 20 as shown in FIG. 1B. The additional fastener provides additional lateral stability between body sections 22 and 24 that helps stabilize the tool through the operating range of adjustment screw 32. However, I prefer to omit fastener 39 if possible and use a guide means, such as a mating pin and recess, at the first end 23 of the tool to provide lateral stability. Those skilled in the art will recognize that a variety of other means are possible for securing the body sections 22 and 24 while at the same time providing for adjustment of the distance between blades 28 and 30 at first end 23.

Blades 28 and 30 are precision steel cutting blades. I obtained the blades as universal 3 hole mini utility knife blades from Industrial Blades Limited of Malvern, Pa., and modified them by scoring and breaking the blades between each of the three mounting holes. Blades 28 and 30 are preferably flat, trapezoidal, with one cutting edge, and a mounting hole located in the approximate center of each blade. Various other types and configurations of blades may be adapted for use with my invention. It is important, however, that any blade used with my invention have a sharp cutting edge, be relatively stiff and precision ground for repeatability of mounting and cutting, and be positively and firmly attached to its respective mounting surface 29 or 31 of body section 22 or 24 near the blade's cutting edge. In order to cut floor covering with the necessary precision, the blade must be able to bear heavy hand pressure without noticeable movement or deflection.

Figure 11:
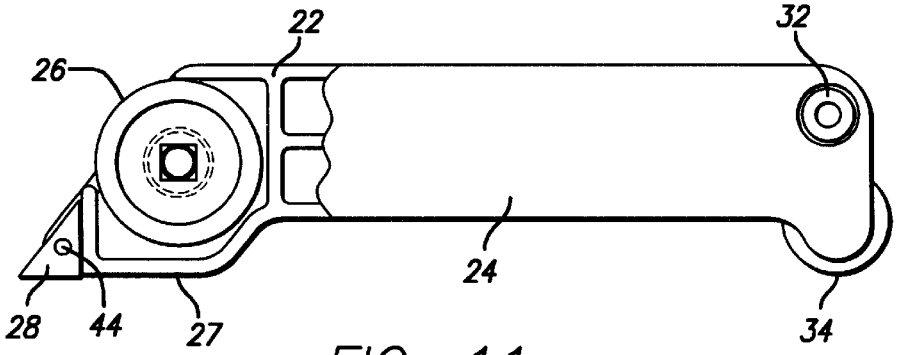
FIG. 11 is a partial breakaway plan view of my repair tool from the side of the second body section, showing the mounting position of the cutting blade and adjustment screw.

Blades 28 and 30 are mounted to sections 22 and 24, respectively, as shown in FIGS. 9, 10, and 11. Each blade is oriented with one of its non-cutting edges against shoulder 54 or 55, respectively, and its cutting edge oriented towards the bottom side 27 of tool 20. Fasteners 44 and 45, respectively, attach blades 28 and 30 to mounting surfaces 29 and 31 of sections 22 and 24. Fasteners 44 and 45 are preferably 6–32 flat head screws or similar small fastener and are adapted to fit into threaded holes 46 and 47 shown in FIGS. 5 and 8.

For purposes of repairing seams in floor coverings, when sections 22 and 24 are in their closest position, shown in FIG. 10, blades 28 and 30 are preferably touching at their rearward portions and have their tips about 0.10 inch apart. When sections 22 and 24 are in their furthest apart position, shown in FIG. 9, the tips of blades 28 and 30 are about 0.35 inches apart. This range of adjustability is useful for most floor covering repairs. Of course, the range of adjustability of the repair tool suitable for use with my invention could vary from the preferred range without departing from the scope of my invention.

Figure 5:
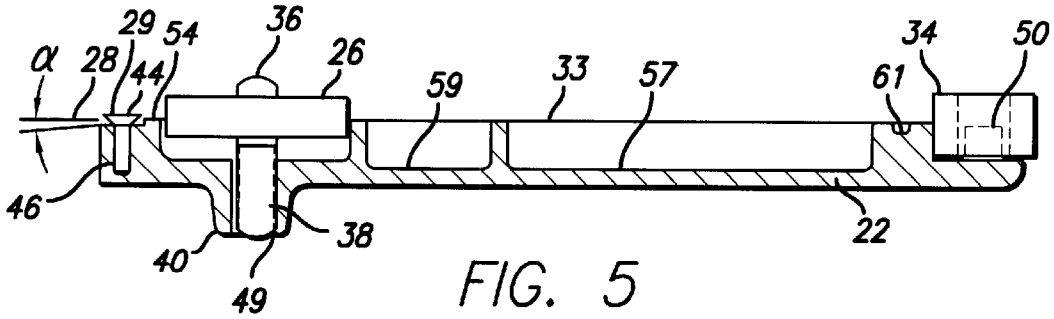
FIG. 5 is a cross section through section 5—5 on FIG. 6, showing various details of construction and assembly of my repair tool.
Figure 8:
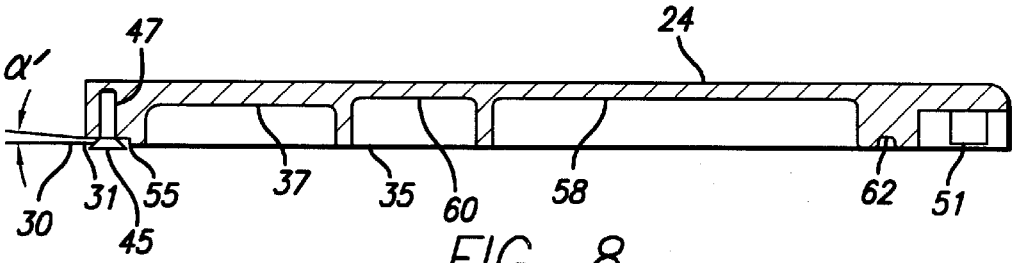
FIG. 8 is a cross section through section 8—8 on FIG. 7, showing various details of construction and assembly of my repair tool.

Mounting surfaces 29 and 31 are preferably inclined with respect to mating surfaces 33 and 35 of body sections 22 and 24, at angles $\alpha$ and $\alpha'$, respectively, shown in FIGS. 5 and 8. As a result, blades 28 and 30 diverge when mounted in tool 20 with an angle of divergence equal to $\alpha$ plus $\alpha'$. The purpose of the divergence is to provide for a beveled undercut, visible in FIG. 12, when tool 20 is used to cut a groove or repair strip. I have found it preferable that $\alpha$ and $\alpha'$ both be about 2°, making the total divergence angle of blades 28 and 30 equal to 4°. Other divergence angles or no divergence angle would provide some functionality. However, if the divergence angle is much greater than 4°, blades 28 and 30 are more likely to cut a ragged edge. In addition, the amount of undercut is greater than needed to repair the seam and will make it more difficult to position the repair strip correctly. Conversely, if the divergence angle is much less than 4°, the undercut is less effective for locking the repair strip in place. Those skilled in the art of tool design will recognize other means for inclining blades 28 and 30 to provide a suitable undercut, other than the method I have disclosed. Various means for providing an undercut may be used, without departing from the scope of my invention.

My repair tool is preferably provided with a means for adjusting the distance between blades 28 and 30. My preferred means for adjustment is an adjustment screw 38 connected to thumbwheel 26. As shown in FIGS. 9 and 10, section 24 at the bottom of recess 43 is maintained against bearing surface 36 of adjustment screw 38 by the compression supplied by fastener 32. Turning thumbwheel 26 so adjustment screw 38 advances out of threaded hole 49 (shown in FIGS. 5 and 6) drives bearing surface 36 against section 24, thereby increasing the distance between blades 28 and 30. Turning thumbwheel 26 in the opposite direction has the opposite effect, bringing the blades closer together. The pressure supplied by fastener 38 against bearing surface 36 provides a continual backload on screw 38, eliminating adjustment slop and creep.

Body sections 22 and 24 are preferably provided with openings 66 and 67, shown in FIGS. 9 and 10. Thumbwheel 26 is preferably mounted on adjustment screw 38 so it protrudes through openings 66 and 67 in handle 21. This mounting position makes tool 20 sleeker and more compact than mounting thumbwheel 38 on the exterior of the tool. It also tends to protect thumbwheel 26 from accidental movement and impact. To facilitate my preferred mounting, body section 22 is provided with boss 40, shown in FIG. 5. Boss 40 permits threaded hole 49 to be of sufficient length for operation of adjustment screw 38. In an alternative embodiment, adjustment screw 38 passes through one of either body section 22 or 24, and thumbwheel 26 is mounted on a side of the exterior of tool 20 as shown in FIG. 1B.

Adjustment screw 38 is preferably about the same diameter as fastener 32 to avoid excessive stress on both screw 38 and fastener 32. Screw 38 is preferably provided with a fine thread having a relatively small pitch. Various suitable threads sizes are known in the art for providing fine and precise adjustment capability.

Figure 6:
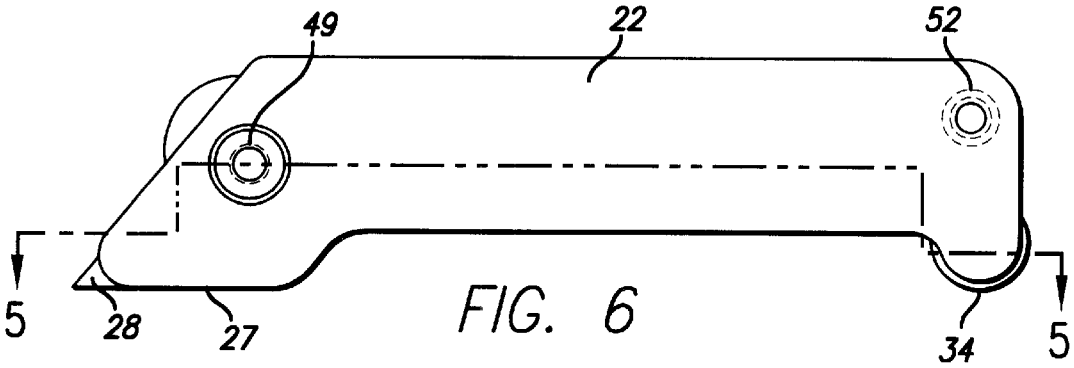
FIG. 6 is a plan view of the exterior of my repair tool from the side of the first body section.
Figure 7:
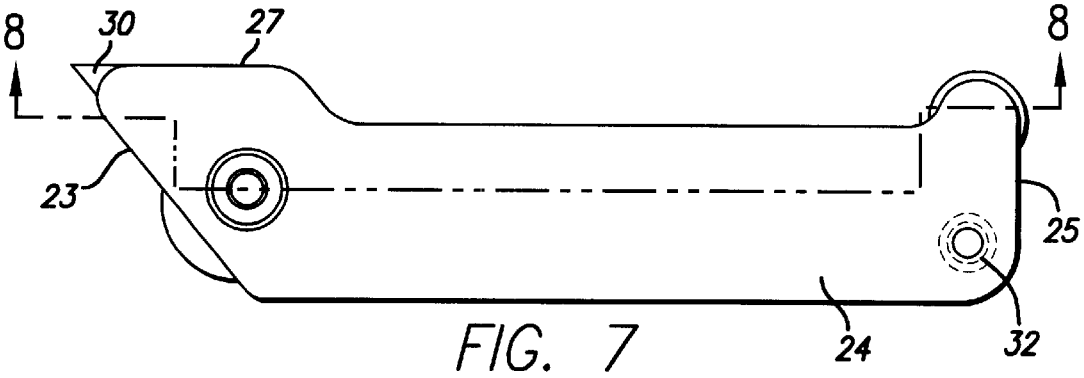
FIG. 7 is a plan view of the exterior of my repair tool from the side of the second body section.

Tool 20 is preferably provided with a roller 34 useful for my repair method. The roller 34 is preferably located on the second end 25 of tool 20 at the corner opposite to fastener 32, as shown in various figures, including FIG. 6. Roller 34 is preferably made from a suitable hard plastic material. Roller 34 is preferably mounted on retention pins 50 and 51 of sections 22 and 24, respectively, when sections 22 and 24 are assembled. Pins 50 and 51 have the advantage of being integral with sections 22 and 24, thereby eliminating the need for additional parts. When sections 22 and 24 are disassembled by removing fastener 32, the preferred mounting permits roller 34 to be removed and replaced. Roller 34 is preferably configured, mounted, and positioned as shown in FIGS. 5 and 6, but other suitable sizes, mountings, and locations for roller 34 are possible, or roller 34 may be omitted entirely, without departing from the scope of my invention.

Figure 4:
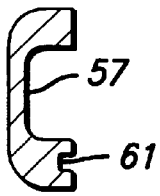
FIG. 4 is a cross section through section 4—4 shown on FIG. 2.

The interior of handle 21 is preferably provided with various recesses in body sections 22 and 24 to accommodate interior components, provide for storage of replacement and auxiliary components, and for lightening the tool body. Recesses 42 and 43 accommodate thumbwheel 26. Recesses 57 and 58 are for storage of a container holding spare blades. Recesses 62 and 62 form an interior recess in handle 21 for holding a wrench for fasteners 44 and 45. A cross section of recesses 57 and 61, which are typical of recesses 58 and 62 also, is shown in FIG. 4. Recesses 59 and 60 are for lightening the tool body and could also be used for storage of small components, if desired.

For convenience of the user, body sections 22 and 24 are preferably provided with recesses 61 and 62 (respectively) which together provide an interior recess in handle 21 for storage of a suitable Allen wrench for adjusting fasteners 44 and 45. As an additional convenience, body sections 22 and 24 are preferably provided with threaded holes 64 and 65, respectively, for holding spare fasteners to replace fasteners 44 or 45, if needed.

Figure 12:
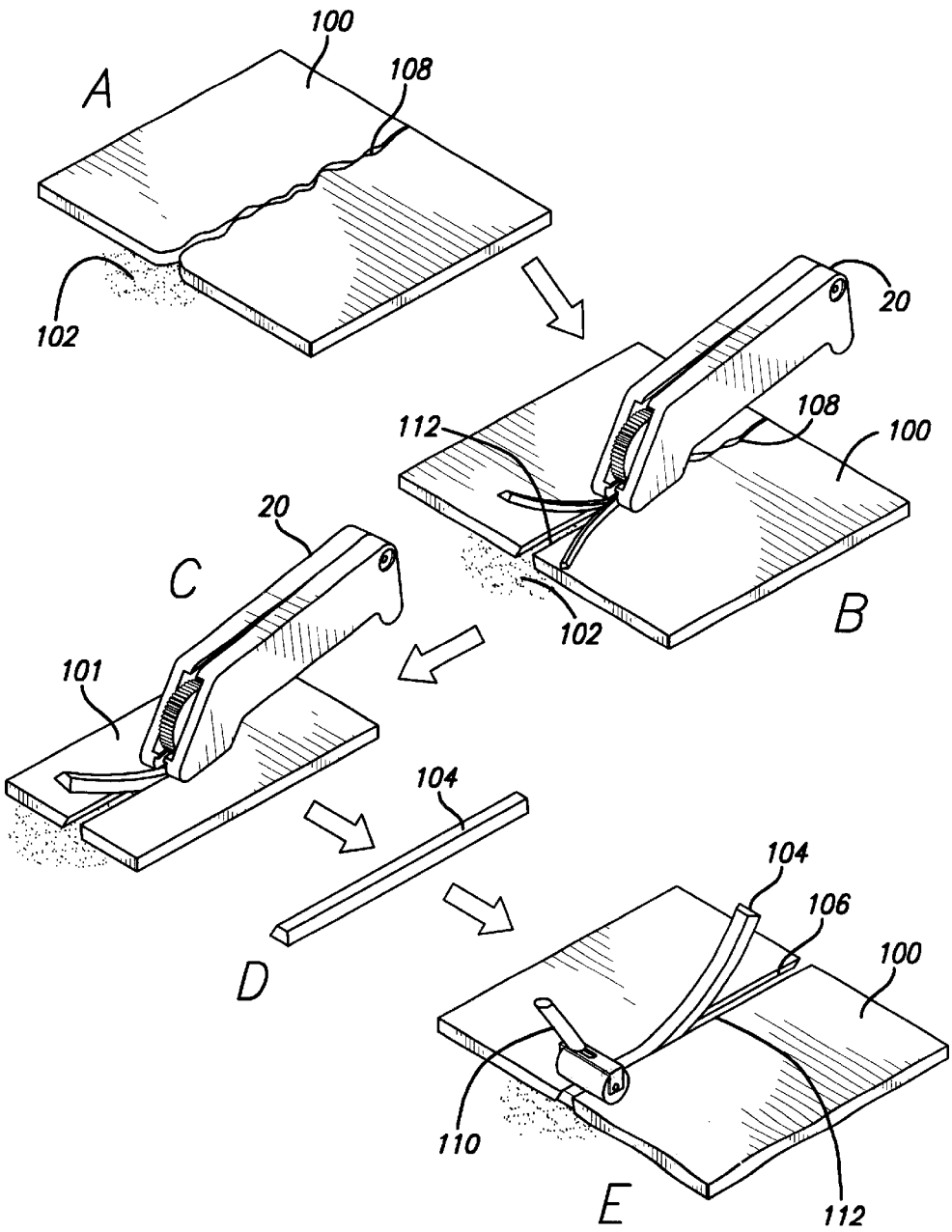
FIG. 12 is an isometric diagram illustrating the method for using my repair tool to repair a seam.

My method for using my repair tool to repair a seam in floor coverings adhered to a floor is diagrammed in FIG. 12. My method could be adapted for use with any tool having two cutting blades suitable for cutting floor coverings, so long as the blades are positioned to make parallel cuts the proper distance apart so as to remove only the damaged portion of the seam. It is preferable for the cutting blades of the tool to be inclined away from one another to undercut the floor covering material and to provide a matching bevel on the repair strip. Prior to development of my repair tool, no tools suitable for use with my method were available. Steps of my method are diagrammed in sequence from the top to bottom of FIG. 12, following the arrows and letter sequence.

A piece of floor covering 100 on a floor 102 with a damaged seam 108 is represented in step A at the top of FIG. 12. The distance between the blades of tool 20 is adjusted to just slightly wider than the widest portion of the damaged seam to be removed. Tool 20 is placed at the first end of the damaged portion of the seam so that a first blade is on a first side of the seam, and a second blade is on a second side of the seam. Tool 20 is then drawn along the length of the damaged portion of the seam to the second end of the damaged portion with the blades straddling the damaged portion of the seam. While tool 20 is drawn along the seam, downward cutting pressure is applied to tool 20, cutting through floor covering 100 to floor 102 and creating two parallel cuts straddling the damaged portion of the seam, as shown in FIG. 12 step B. The operator then removes the material between the parallel cuts and cleans out the resulting groove 112 in floor covering 102. Then, the operator selects a piece of scrap floor covering material 101 selected to match the decorative pattern of the material removed from floor covering 100. The operator cuts a strip of the same length and pattern as the removed material from the selected scrap piece 101 as shown in FIG. 12 step C. This becomes repair strip 104 shown in FIG. 12 step D.

However, before cutting repair strip 104, the blades of tool 20 are preferably adjusted to be slightly wider apart than when cutting out the damaged portion of the seam. Increasing the distance between the blades at least one but no more than ten thousands of an inch is optimal for most materials and seams. With the preferred embodiment of my repair tool, turning adjustment screw 38 approximately one quarter turn will make a proper adjustment. A proper adjustment ensures that repair strip 104 will fit snugly into the groove 112.

After cutting the repair strip, the operator trims its ends to fit into the groove 112 and match the surrounding floor covering 100. The operator then applies a small amount of flooring adhesive 106 along the bottom of the groove 112. The operator positions the repair strip 104 in groove 112 so that the pattern on strip 104 matches the adjoining floor covering 100. Using a roller 110, the operator presses the repair strip in place along the groove 112 as shown in FIG. 12 step E. My repair tool is equipped with roller 34 for this purpose, but almost any roller may be used. The matching bevels of repair strip 104 and the groove 112 help to lock the repair strip in place. Furthermore, the edges of repair piece 104 match the groove 112 perfectly and are uniformly snug along the length of the patch. Thus, repair strip 104 is held firmly in place with its edges matching the repaired piece as well or better than the original seam. To complete the repair, a conventional seam sealing adhesive is applied over the surface of the repaired area to weld the repair strip in place and seal it from contamination.

Thus I have provided a way to easily and quickly perform perfect repairs of damaged seams in abutting pieces of floor covering. Craftspeople and amateur repair people of many different skill levels and abilities are able to competently repair a seam using my tool and method. My repair tool is inexpensive to construct, rugged, reliable, and easy to operate. The method for using it is easy to teach, easy to learn, and easy to do. Thus, my invention will be of value to anyone who needs to repair seams in sheet materials, and especially floor coverings.

Various modifications and alterations of the embodiments of my invention will become apparent to those skilled in the art without departing from my invention's scope. The scope of my invention is limited only by the elements of the claims that follow, and is not limited by the particular embodiments that I have disclosed.

What is claimed is:

1. A method for repairing a seam in abutting pieces of floor covering, wherein said seam has a damaged portion having a first end, a second end, and a length, the method comprising the steps of;

(a) placing a tool having two cutting blades positioned to make parallel cuts on each of said pieces of floor covering at said first end of said damaged portion, so that a first blade of said tool is on one side of said seam, and a second blade of said tool is on a second side of said seam;

(b) drawing said tool along said seam to cut through said floor covering on each side of said seam from said first end of said damaged portion to said second end of said damaged portion, while maintaining said first blade on said first side of said seam and said second blade on said second side of said seam, thereby forming two parallel cuts straddling said damaged portion of said seam;

(c) lifting said tool from said pieces of floor covering;

(d) removing the damaged portion of said seam between said parallel cuts to form a groove in said floor covering having a length equal to or greater than the damaged portion of the seam;

(e) placing said tool on a piece of scrap floor covering positioned to cut a strip matching the type and pattern of the material removed in step (d);

(f) drawing said tool over said piece of scrap floor covering to cut a repair strip matching the pattern and length of the material removed in step (d);

(g) positioning said repair strip in said groove to match said floor covering on each side of said groove to form a repaired seam.

2. The method of claim 1, comprising the additional step of adjusting the blades of said tool between steps 1(d) and 1(e) so that said repair strip has a width slightly greater than said groove.

3. The method of claim 1, wherein said tool is provided with blades that are positioned to undercut said floor covering along at least one side of said seam and to cut at least one beveled edge along the length of said repair strip to match said undercut.

4. The method of claim 1, comprising the additional step of adhering said repair strip in said groove with adhesive by applying adhesive to at least one of said repair strip or said groove before said repair strip is positioned in said groove.

5. The method of claim 1, comprising the additional step of applying a seam sealing adhesive along a top surface of said repaired seam after said repair strip is positioned in said groove.

* * * * *